US011013284B2

(12) United States Patent
Ong

(10) Patent No.: US 11,013,284 B2
(45) **Date of Patent: *May 25, 2021**

(54) ADJUSTABLE STRAP FOR HAT

(71) Applicant: LEAGUE OF INVESTORS, LLC, Garden Grove, CA (US)

(72) Inventor: Danny Ong, Westminster, CA (US)

(73) Assignee: LEAGUE OF INVESTORS, LLC, Garden Grove, CA (US)

( * ) Notice: Subject to any disclaimer, the term of this patent is extended or adjusted under 35 U.S.C. 154(b) by 167 days.

This patent is subject to a terminal disclaimer.

(21) Appl. No.: 16/259,216

(22) Filed: Jan. 28, 2019

(65) Prior Publication Data

US 2019/0150545 A1 May 23, 2019

Related U.S. Application Data

(63) Continuation of application No. 15/961,740, filed on Apr. 24, 2018, now Pat. No. 10,238,161, which is a (Continued)

(51) Int. Cl.
*A42B 1/22* (2006.01)
*A42B 7/00* (2006.01)
(Continued)

(52) U.S. Cl.
CPC ..... *A42B 1/22* (2013.01); *A42B 7/00* (2013.01); *A44B 11/20* (2013.01); *A44B 99/005* (2013.01); *A42B 3/145* (2013.01); *A44B 11/22* (2013.01)

(58) Field of Classification Search
CPC ..... A42B 1/22; A42B 3/145; A44B 11/20; A44B 99/005; A44B 11/22
See application file for complete search history.

(56) References Cited

U.S. PATENT DOCUMENTS 809,465 A 1/1906 Roy
1,575,291 A 3/1926 Trau
(Continued)

FOREIGN PATENT DOCUMENTS

BR 6602423 U 8/1987
CN 103156321 A 6/2013
(Continued)

OTHER PUBLICATIONS

Ivanova, T., "The International Search Report and the Written Opinion of the International Searching Authority," Patent Cooperation Treaty (PCT), dated Mar. 21, 2019, 7 pages, PCT Application No. PCT/US2018/052045, Moscow, Russia.
(Continued)

*Primary Examiner* — Khaled Annis
(74) *Attorney, Agent, or Firm* — Klein, O'Neill & Singh, LLP

(57) ABSTRACT

An adjustable connector strap may include two interlocking bodies, wherein one body includes a plurality of teeth located along opposing edges, and the other body includes a plurality of notches located along opposing edges. The user may select the number of teeth that are mated with the notches to adjust the size of the strap. The use of interlocking teeth and notches along the opposed edges of the strap bodies may enhances the ability of the strap to maintain its interlocking strength during tension loads. The teeth and notch engagement may also allow a user to quickly engage or disengage the strap bodies, thereby enhancing the ease-of-use of the strap.

8 Claims, 11 Drawing Sheets

Related U.S. Application Data continuation-in-part of application No. 15/732,888, filed on Jan. 16, 2018, now Pat. No. 10,238,185, and a continuation-in-part of application No. 29/651,161, filed on Jan. 16, 2018, now abandoned, and a continuation-in-part of application No. 29/620,987, filed on Sep. 28, 2017, now abandoned.

(60) Provisional application No. 62/709,322, filed on Jan. 16, 2018, provisional application No. 62/707,083, filed on Oct. 23, 2017.

(51) Int. Cl.

| | |
|---|---|
| ***A44B 99/00*** | (2010.01) |
| ***A44B 11/20*** | (2006.01) |
| *A42B 3/14* | (2006.01) |
| *A44B 11/22* | (2006.01) |

(56) References Cited

U.S. PATENT DOCUMENTS

| | | | |
|---|---|---|---|
| 3,192,589 | A | 7/1965 | Pearson |
| 3,263,292 | A | 8/1966 | Fekete |
| 4,377,872 | A | 3/1983 | Daniell, Jr. |
| 4,520,533 | A | 6/1985 | Kasai |
| 4,577,375 | A | 3/1986 | Beaussant |
| 4,640,287 | A | 2/1987 | Anderson |
| D299,380 | S | 1/1989 | Wang |
| 4,872,218 | A | 10/1989 | Holt |
| 4,976,017 | A | 12/1990 | Frano |
| D324,193 | S | 2/1992 | Wen-Long |
| 5,212,838 | A | 5/1993 | Davidson |
| D342,595 | S | 12/1993 | Day |
| 5,272,772 | A | 12/1993 | Hahn |
| 5,581,850 | A | 12/1996 | Acker |
| 5,640,744 | A | 6/1997 | Allan |
| 5,652,959 | A | 8/1997 | Proctor |
| 5,797,170 | A | 8/1998 | Akeno |
| 5,862,523 | A | 1/1999 | Proctor |
| 5,878,520 | A | 3/1999 | Milbrandt |
| 6,941,581 | B1 | 9/2005 | England |
| D616,181 | S | 5/2010 | Harada |
| D668,843 | S | 10/2012 | Lalonde |
| D675,404 | S | 2/2013 | Parker |
| 8,650,665 | B2 | 2/2014 | Shirai |
| 9,198,475 | B2 | 12/2015 | Park |
| 9,198,483 | B2 | 12/2015 | Adams |
| D753,375 | S | 4/2016 | Singleterry |
| D753,905 | S | 4/2016 | Singleterry |
| D754,950 | S | 5/2016 | Singleterry |
| D754,951 | S | 5/2016 | Singleterry |
| 9,392,846 | B2 | 7/2016 | Shirai |
| D770,148 | S | 11/2016 | Hwang |
| D770,733 | S | 11/2016 | Hwang |
| D771,914 | S | 11/2016 | Cho |
| 9,655,397 | B2 | 5/2017 | Cho |
| D793,675 | S | 8/2017 | Gates |
| 9,763,486 | B2 | 9/2017 | Lacy |
| 10,238,161 | B1 | 3/2019 | Ong |
| 10,238,185 | B1 | 3/2019 | Ong |
| 2004/0187191 | A1 | 9/2004 | Lee |
| 2005/0115028 | A1 | 6/2005 | Cheung |
| 2006/0096004 | A1 | 5/2006 | Friton |
| 2007/0245466 | A1 | 10/2007 | Lilenthal |
| 2008/0134414 | A1 | 6/2008 | Cho |
| 2009/0277938 | A1 | 11/2009 | Baron |
| 2010/0281661 | A1 | 11/2010 | Harada |
| 2011/0214223 | A1 | 9/2011 | Rogers |
| 2012/0297521 | A1 | 11/2012 | Shirai |
| 2014/0053319 | A1 | 2/2014 | Cho |
| 2014/0101820 | A1 | 4/2014 | Cho |
| 2016/0353846 | A1 | 12/2016 | Zanghi |
| 2017/0079362 | A1 | 3/2017 | Olcese |
| 2017/0182732 | A1 | 6/2017 | Toronjo |
| 2018/0153241 | A1 | 6/2018 | Cho |

FOREIGN PATENT DOCUMENTS

| | | | |
|---|---|---|---|
| CN | 106455737 | A | 2/2017 |
| RU | 2223683 | C2 | 2/2004 |
| WO | 1999026502 | A1 | 6/1999 |

OTHER PUBLICATIONS

"First Office Action," China National Intellectual Property Administration, dated Oct. 12, 2020, Chinese Patent Application No. 2018800183916.

ADJUSTABLE STRAP FOR HAT

CROSS-REFERENCE TO RELATED APPLICATIONS

This application is a continuation of U.S. patent application Ser. No. 15/961,740, filed Apr. 24, 2018, which is a continuation-in-part of U.S. patent application Ser. No. 15/732,888, filed Jan. 16, 2018, U.S. Design patent application No. 29/651,161, filed on Jan. 16, 2018, and U.S. Design patent application No. 29/620,987, filed on Sep. 28, 2017, and relates to U.S. Provisional Application No. 62/709,322, filed Jan. 16, 2018, and U.S. Provisional Application No. 62/707,083, filed Oct. 23, 2017, the entire contents of which are expressly incorporated herein by reference.

STATEMENT RE: FEDERALLY SPONSORED RESEARCH/DEVELOPMENT

Not Applicable

BACKGROUND

1. Technical Field

The present disclosure relates generally to adjustable strap connectors, and more specifically, to interlocking strap connectors having opposing teeth which mate with corresponding opposing notches.

2. Description of the Related Art

Articles of clothing, such as hats, caps, and belts, may require size adjustment to fit an individual wearer. Accordingly, there is a need in the art for an improved connector, and a method of using the same, that addresses this issue.

BRIEF SUMMARY

Various aspects of the present disclosure relate to an adjustable connector strap, which may be used on a hat for adjusting the size of the hat to fit a user's head. The adjustable connector strap may include two interlocking bodies, wherein one body includes a plurality of opposing teeth located along opposing edges, and the other body includes a plurality of opposing notches located along opposing edges. The user may select the number of teeth that are mated with the notches to adjust the size of the strap. The use of interlocking opposing teeth and notches along the opposed edges of the strap bodies helps to balance the load between the opposing teeth and opposing notches when the strap is under tension load. The opposing configurations of the teeth and notch engagement may also help a user to quickly engage or disengage the strap bodies with one hand, thereby enhancing the ease-of-use of the strap.

There may be provided an adjustable connector strap for a hat. The adjustable connector strap may include a first body extending along a first longitudinal axis. The first body may include a base having a pair of opposed lateral edges, and a plurality of teeth extending from the base. The plurality of teeth may include a first set of teeth and a second set of teeth positioned adjacent respective ones of the pair of opposed lateral edges. Each tooth may include a first portion and a second portion, with the first portion being positioned between the second portion and the base. Each tooth may define a width in a direction parallel to the first longitudinal axis, with the maximum width of the second portion being greater than the maximum width of the first portion. The adjustable connector strap may additionally include a second body extending along a second longitudinal axis. The second body may include a pair of opposed lateral edges, and a plurality of notches comprising a first set of notches and a second set of notches. The plurality of notches may be complimentary in shape to the plurality of teeth. The second body may be selectively engagable with the first body in a first engaged configuration and a second engaged configuration. The number of teeth being received in corresponding ones of the plurality of notches increasing as the second body transitions from the first engagement configuration to the second engagement configuration.

A degree of overlap between the first body and the second body may increase as the second body transitions from the first engagement configuration to the second engagement configuration.

The second body may include a first surface, an opposing second surface, a plurality of sidewalls extending between first and second surface, and a plurality of projections extending from respective ones of the plurality of sidewalls.

In a cross sectional plane passing through both the first and second bodies when the second body is in the first engaged configuration, the cross sectional plane being parallel to the first and second longitudinal axes and passing through at least one tooth and at least one notch, the at least one tooth may include a first portion width defined by the first portion and a second portion width defined by the second portion, and the at least one notch may include a maximum width and a minimum width. The minimum width may be defined by the projection, and the minimum width may be greater than the first portion width and less than the second portion width.

Each of the first set of teeth may be aligned with a corresponding one of the second set of teeth along a respective axis perpendicular to the first longitudinal axis.

Each of the first set of notches may be aligned with a corresponding one of the second set of notches along a respective axis perpendicular to the second longitudinal axis.

Each tooth may include a triangular periphery. Each tooth may include an arcuate surface.

The second body may include one of a logo an indicia formed thereon.

There may also be provided a method of using an adjustable connector strap. The method may include placing the second body on the first body, and moving the first set of notches on the second body toward the first set of teeth on the first body.

The method may further comprise the step of pressing the first set of notches toward the first set of teeth to cause engagement between at least one of the first set of notches and at least one of the first set of teeth. The method may additionally include the step of pressing the second set of notches toward the second set of teeth to cause engagement between at least one of the second set of notches and at least one of the second set of teeth.

There may further be provided a headwear member wearable on a head of a user. The headwear member may include a crown body positionable adjacent the head of a user, a first body connected to a first portion of the crown body, and a second body connected to a second portion of the crown body.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
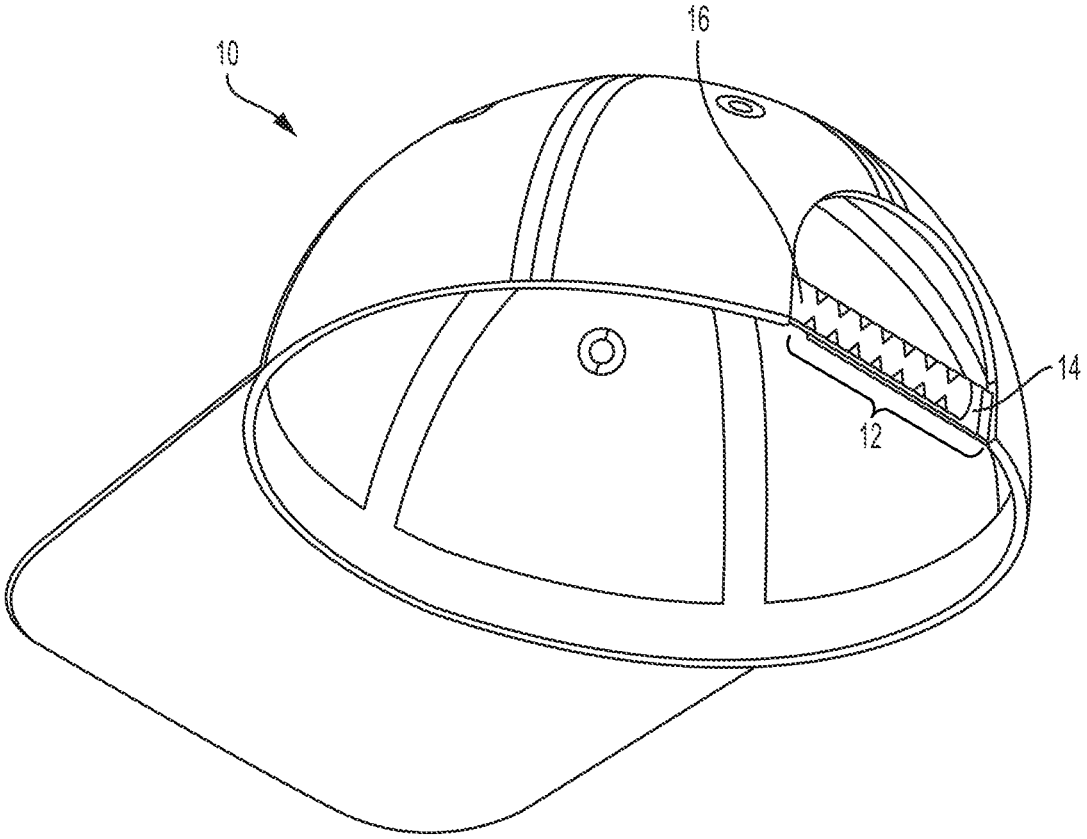
FIG. 1 is a lower perspective view of a hat having an adjustable connector strap according to one aspect of the present disclosure.

Referring now to the drawings wherein the showings are for purposes of illustrating a preferred embodiment of the present disclosure, and are not for purposes of limiting the same, FIG. 1 shows a hat 10 having an adjustable connector strap 12 for adjusting the size of the hat 10 to fit a user's head. The adjustable connector strap 12 may include two interlocking bodies 14, 16 (see FIGS. 1 and 2) that are easily connectable and disconnectable to allow for one-handed engagement of the interlocking bodies 14, 16. One body 14 may include a plurality of teeth 18 positioned along its longitudinal edges, while the other body 16 may include a plurality of notches 26 positioned along its longitudinal edges. The teeth 18 and notches 26 may be similarly sized and shaped to allow the teeth 18 to be mated with the notches 26 to engage the two interlocking bodies 14, 16 to each other. The number of teeth 18 that are mated with corresponding notches 26 may be varied depending on the desired size of the hat. Placing more teeth 18 in the notches 26 may result in more overlap between the two bodies and a shorter length of the adjustable connector strap 12. Placing fewer teeth 18 in the notches 26 may result in less overlap between the two bodies and a longer length of the adjustable connector strap 12. The opposed position of the teeth 18 and notches 26 on the respective bodies 14, 16 balance the tension load when applied. The position and configuration of the teeth 18 and notches 26 may additionally allow for self-alignment of the two bodies 14, 16 when connecting the two bodies 14, 16 together, thereby allowing for quick and easy engagement between the two bodies 14, 16. The self-alignment may also allow the two bodies 14, 16 to be engaged with each other using only one hand, whereas conventional hat connector straps typically required the use of two hands for engagement.

Referring now specifically to FIG. 2-5, the adjustable connector strap 12 may include a first body 14 and a second body 16. The first body 14 may include a plurality of triangularly-shaped teeth 18 arranged in a first set adjacent a first lateral edge 20 (see FIG. 2) of the first body 14, and a second set adjacent an opposing second lateral edge 22 (see FIG. 2) of the first body 14. Relative to a first longitudinal axis 24 (see FIG. 3) defined by the first body 14, the teeth 18 arranged adjacent the first lateral edge 20 may be a mirror image of the teeth 18 arranged adjacent the second lateral edge 22. In this respect, each tooth 18 positioned adjacent the first lateral edge 20 may be aligned with a corresponding tooth 18 positioned adjacent the second lateral edge 22 along an axis that is perpendicular to the first longitudinal axis 24. Alternatively, it is also contemplated that the teeth 18 adjacent the first lateral edge 20 may be axially offset from the teeth 18 adjacent the second lateral edge 22. Thus, the scope of the present disclosure is not limited to any particular spacing or arrangement of the teeth 18.

The second body 16 may include a plurality of triangularly shaped notches 26 formed therein, with each notch 26 being sized and shaped to receive a respective tooth 18 to facilitate engagement between the first and second bodies 14, 16. The plurality of notches 26 may comprise a first set adjacent a first lateral edge 28 (see FIG. 2) of the second body 16, and a second set adjacent a second lateral edge 30 (see FIG. 2) of the second body 16. Relative to a second longitudinal axis 32 (see FIG. 3) defined by the second body 16, the notches 26 arranged adjacent the first lateral edge 28 may be a mirror image of the notches 26 arranged adjacent the second lateral edge 30. In this respect, each notch 26 positioned adjacent the first lateral edge 28 may be aligned with a corresponding notch 26 positioned adjacent the second lateral edge 30 along an axis that is perpendicular to the second longitudinal axis 32. Alternatively, it is also contemplated that the notches 26 adjacent the first lateral edge 28 may be axially offset from the notches 26 adjacent the second lateral edge 30. Thus, the scope of the present disclosure is not limited to any particular spacing or arrangement of the notches 26. However, the spacing and arrangement of the notches 26 may match the spacing and arrangement of the teeth 18.

FIGS. 2-5 show the first and second bodies 14, 16 connected to each other to define a strap length, L. The strap length L may be defined by a distance between a rear edge 33 (see FIG. 3) on the first body 14 and a rear edge 35 (see FIG. 3) on the second body 16. The strap length L is adjustable by adjusting the relative positions of the rear edges 33, 35 on the first and second bodies 14, 16. As the rear edges 33, 35 are moved closer together, the strap length L may be decreased, and as the rear edges 33, 35 are moved further apart, the strap length L may be increased. Although the foregoing uses the rear edges 33, 35 to define the strap length L, it is contemplated that the strap length L may be defined by any two fixed points (e.g., stitch lines 36) on the first and second bodies 14, 16, i.e., the definition of the strap length L is not limited to being defined by the rear edges 33, 35.

The first and second bodies 14, 16 may be slightly flexible to allow the first and second bodies 14, 16 to be peeled apart during disengagement, yet rigid so as to generally retain their respective shapes (e.g., resistant to elastic stretching) under normal loads. The first and second bodies 14, 16 may be formed from materials such as plastics, rubber, silicone, or other flexible materials known in the art. The first and second bodies 14, 16 may be molded, 3-D printed, or formed via other manufacturing techniques known in the art.

The first and second bodies 14, 16 may be made from contrasting colors, or from colors associated with a particular team, school, or organization. When the first and second bodies 14, 16 are engaged with each other, at least some of the teeth 18 on the first body 14 engaged to the notches 26 on the second body 16 may be visible from the outside, and a significant portion of the second body 16 may also be visible. Thus, by forming the first and second bodies 14, 16 in the colors of a particular team or organization, the strap 12 may contribute to the overall visual association with the particular team, school, or organization. For instance, for a team having colors of purple and gold, the first body 14 may be purple and the second body 16 may be gold to show the purple teeth 18, or vice versa to show gold teeth.

Figure 2:
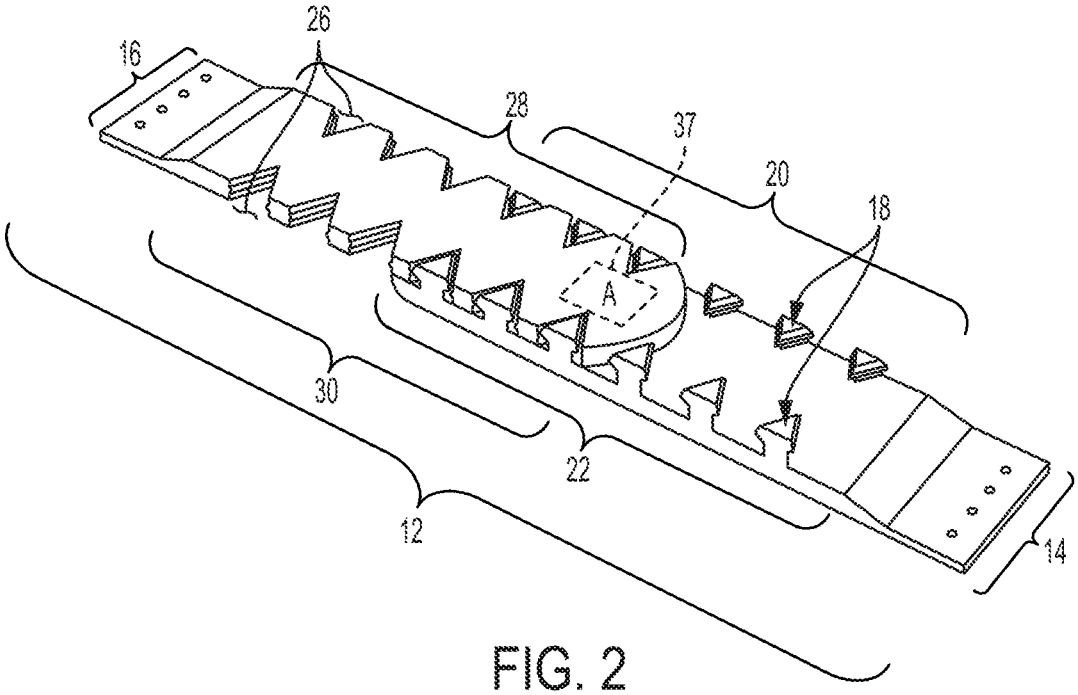
FIG. 2 is an upper perspective view of the adjustable connector strap.
Figure 3:
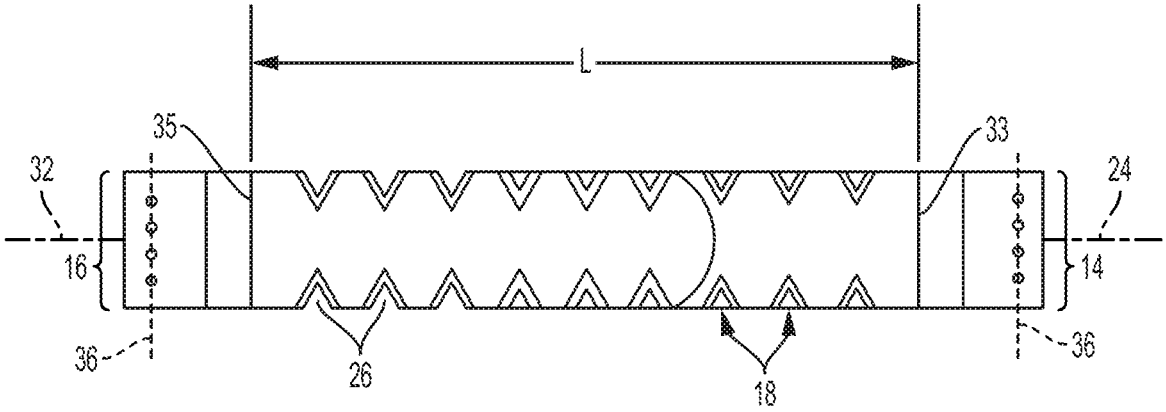
FIG. 3 is top view of the adjustable connector strap.
Figure 4:
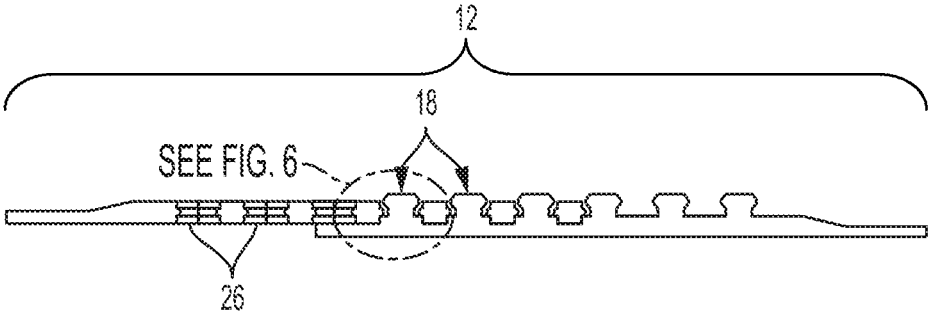
FIG. 4 is a side view of the adjustable connector strap.
Figure 5:
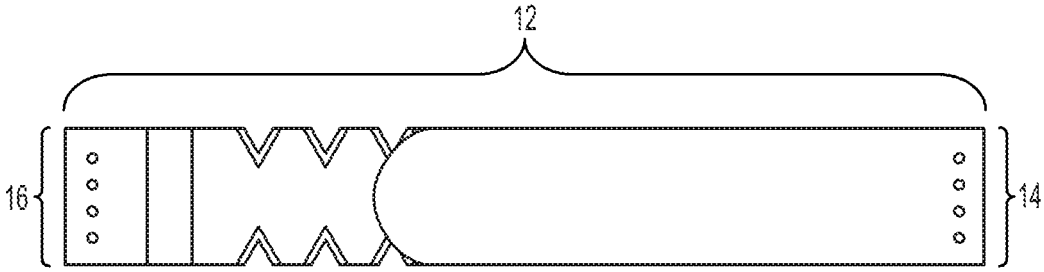
FIG. 5 is a bottom view of the adjustable connector strap.

The first and or second bodies 14, 16 may additionally include a logo or indicia of a team, school, or organization formed thereon. FIG. 2 shows logo region 37 formed on second body, wherein the logo region 37 may include such logo or indicia. The peripheral configuration and size of the logo region 37 may vary depending on the particular logo or indicia. For instance, in relation to a sports team, the logo region 37 may take on the shape and configuration of the mascot or team emblem. The logo region 37 may be raised relative the remainder of the second body 16 and extend between the opposing sets of teeth 18. It is contemplated that since the logo region 37 may be raised relative to the remainder of the second body 16, at least a portion of the logo region 37 may extend over one or more teeth 18. As such, the logo region 37 may be more visually prominent than the remainder of the strap 12, thereby allowing the logo or indicia to project or visually stand out. Therefore, while the hat 10 on which the strap 12 is used may include logos or indicia on the front of the hat 10, as is common placement for logos or indicia, the strap 12 may also include logos or indicia. In this regard, if the hat 10 is worn in a conventional manner with the strap 12 extending along the back of the user's head, people behind the wearer may see the logo or indicia. Conversely, if the hat 10 is worn in a backwards manner, with the strap 12 extending across the wearer's forehead, people facing the wearer may see the logo or indicia. Thus, the strap 12 may not only serve the function of adjusting the size of the hat 10 to fit the hat 10 to the size of the wearer's head, the strap 12 may also add to the overall aesthetic quality of the hat 10 and strengthen the association with the particular team, school, or organization.

Figure 7:
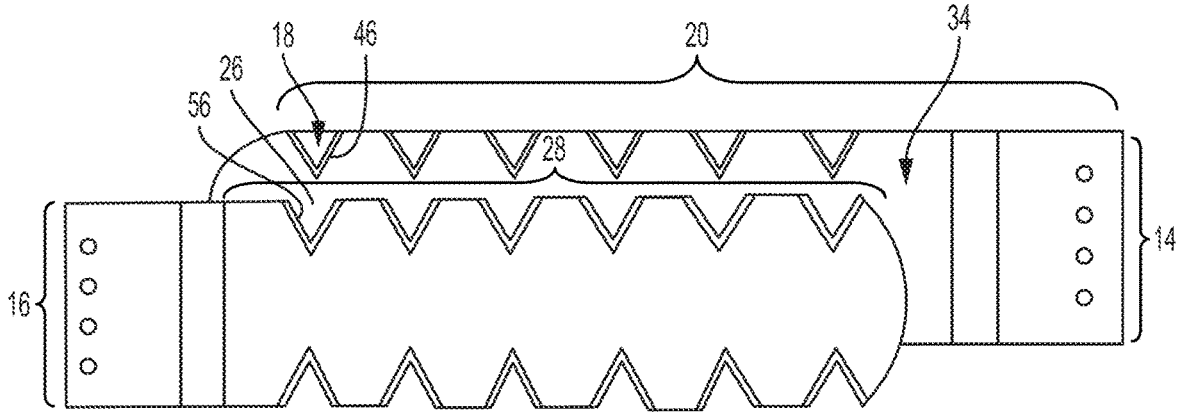
FIGS. 7-9 are top views depicting a process of attaching a first body of the adjustable connector strap to a second body of the adjustable connector strap.
Figure 8:
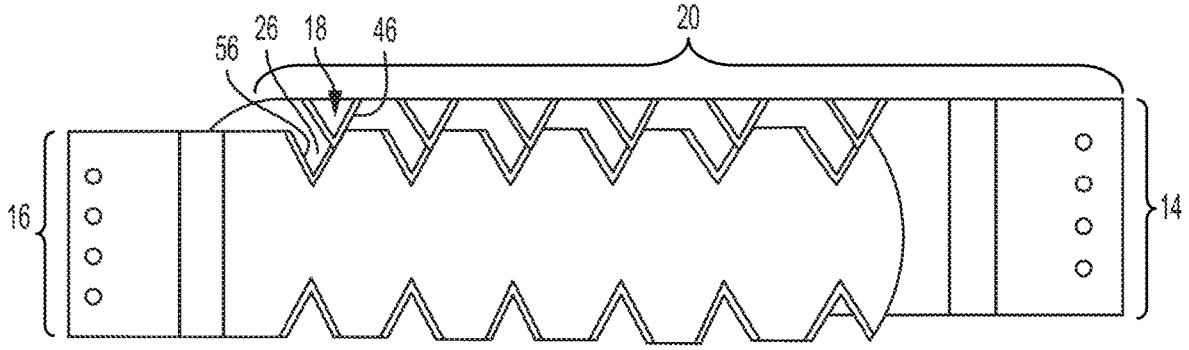
Figure 9:
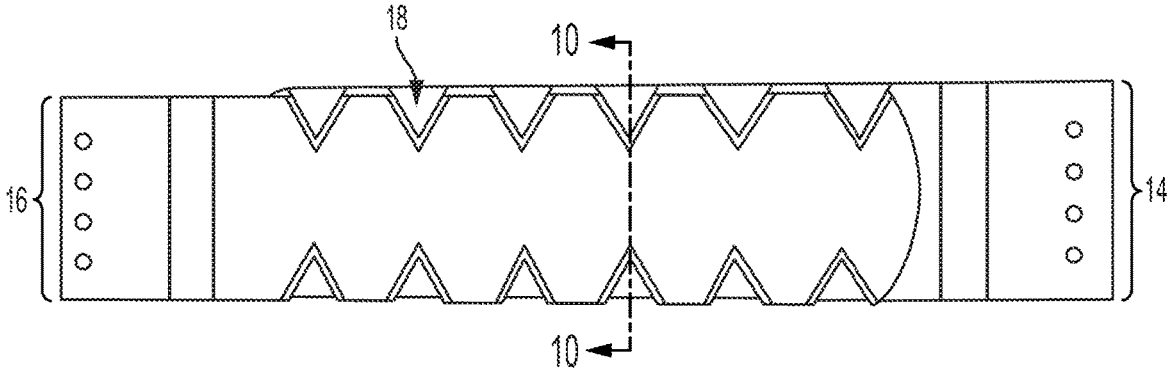
Figure 10:
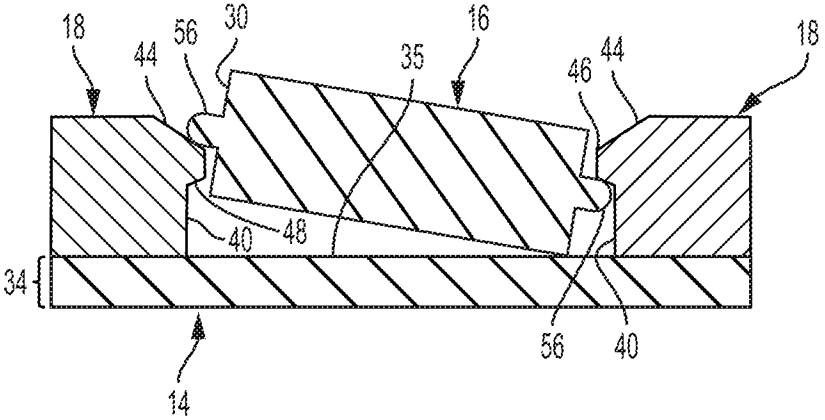
FIG. 10 is a cross sectional view of the adjustable connector strap in the position depicted in FIG. 9.
Figure 11:
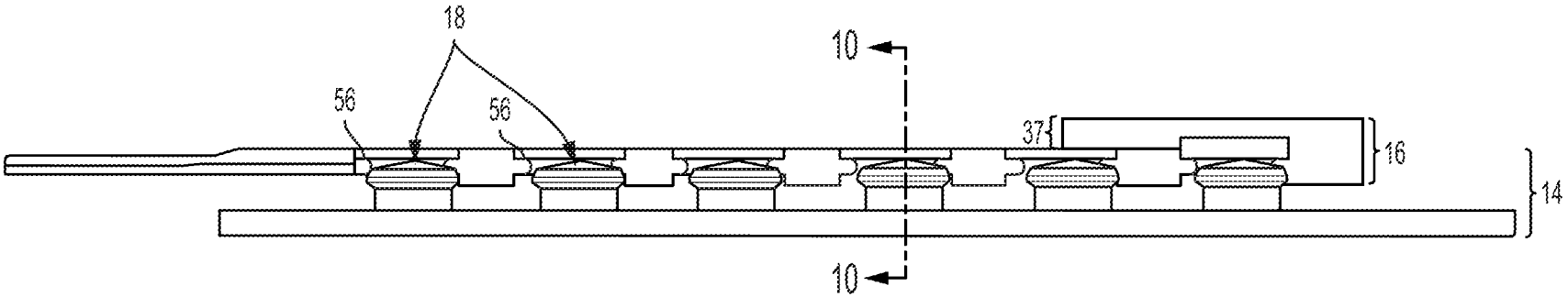
FIG. 11 is a side view of the adjustable connector strap in the position depicted in FIG. 9.
Figure 12:
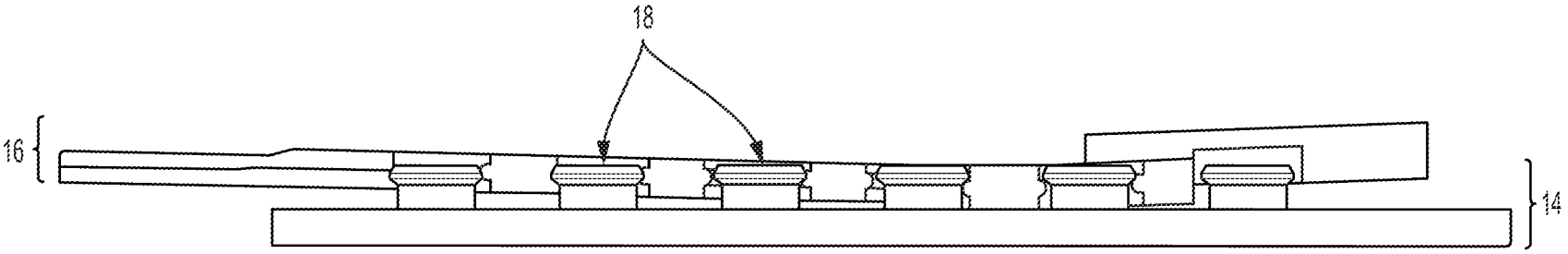
FIGS. 12 and 13 are sequential side views of the adjustable connector strap transitioning toward complete engagement between the first and second bodies.
Figure 13:
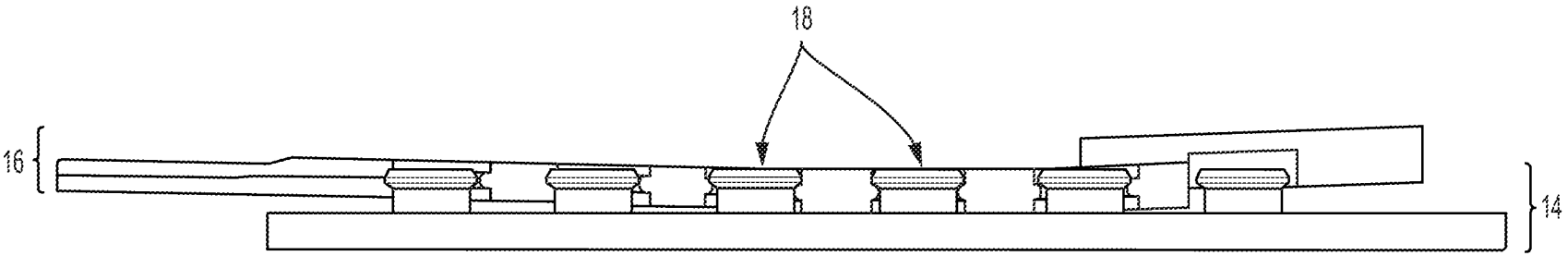

In general, when connecting the first and second bodies 14, 16 together, a user may position the second body 16 over the first body 14 with a degree of overlap associated with a desired length L. To engage the first and second bodies 14, 16 together, one lateral edge 28 of the second body 16 may be placed on a surface 35 of the first body 14 extending between the teeth 18 as shown in FIG. 7. The lateral edge 28 of the second body 16 may be traversed toward one set of teeth 18 so that the set of teeth 18 are received into the notches 26 as shown in FIG. 8. If the teeth 18 and the notches 26 are not perfectly aligned as shown in FIG. 8, moving the lateral edge 28 further toward the teeth 18 will move the second body left to right until the teeth 18 are perfectly received into the notches 26 as shown in FIG. 9. At this point, the second body rests on the first body as shown in FIG. 10. The user may press along the lateral edge 30 of the second body 16 to snap the second body 16 onto the first body 14 as shown in FIGS. 11-13.

Figure 6:
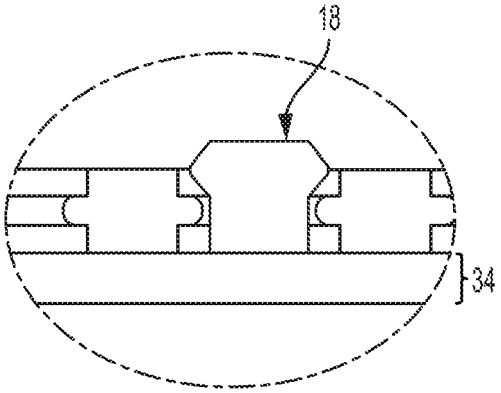
FIG. 6 is an enlarged, partial side view of the adjustable connector strap.
Figure 6A:
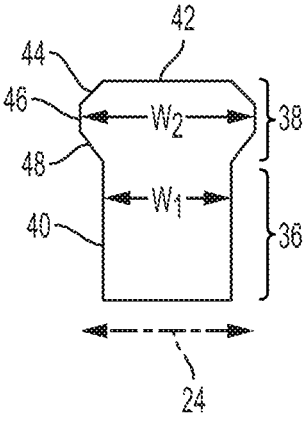
FIG. 6A is an enlarged, side view of the tooth shown in FIG. 6.

The configuration of the teeth 18 and notches 26 may facilitate the self-locating and subsequent press-fit engagement between the first and second bodies 14, 16, and thus, the details regarding the structure of the teeth 18 and notches 26 are discussed below. Referring now specifically to FIGS. 6 and 6A, the first body 14 may include a base 34 extending between the opposed lateral edges 20, 22. Each of the teeth 18 may extend from the base 34 and include a first portion 36 and a second portion 38, with the first portion 36 being positioned between the base 34 and the second portion 38. The first portion 36 may include a lower sidewall 40 which extends from the base 34. The second portion 38 may include an outer surface 42, a chamfered surface 44, a peripheral surface 46, and an undercut surface 48. The outer surface 42 may be generally parallel to the surface 35 of the base 34, and the peripheral surface 46 may be generally perpendicular to the surface 35 of the base 34. The chamfered surface 44 may extend between the outer surface 42 and the peripheral surface 46, and the undercut surface 48 may extend between the peripheral surface 46 and the lower sidewall 40. The angle of the chamfered surface 44 and the undercut surface may be 45° and 135° respectively. Each tooth 18 may define a width in a direction parallel to the first longitudinal axis 24, with the maximum width $W_2$ of the second portion 38 being greater than the maximum width $W_1$ of the first portion 36.

Figure 6B:
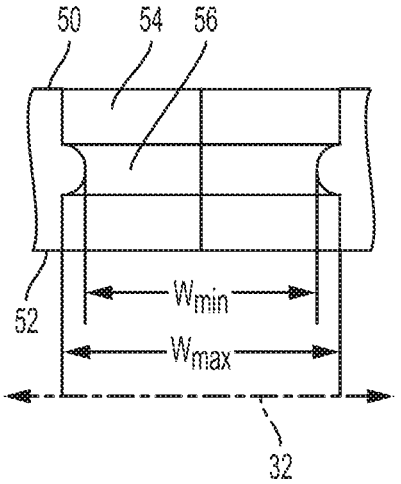
FIG. 6B is an enlarged, side view of the notch shown in FIG. 6.

Referring now to FIGS. 6 and 6B, the second body 16 may include a first surface 50, an opposing second surface 52, and a plurality of sidewalls 54 extending between the first surface 50 and the second surface 52. The second body 16 may additionally include a plurality of projections 56 extending from a respective sidewall 54. The projection may include a rounded or arcuate configuration to facilitate passage over the teeth 18, as will be described in more detail below. Each notch 26 may be collectively defined by a single sidewall 54 and a single projection 56. Each notch 26 may define a width in a direction parallel to the second longitudinal axis 32. In a given cross section taken parallel to the longitudinal axis 32, the notch 26 may define a minimum width $W_{min}$ at the projection 56, and a maximum width $W_{max}$ at the sidewall 54.

The teeth 18 and notches 26 may be sized and configured such that in a given cross section taken parallel to the first and second longitudinal axes 24, 32 when the first and second bodies 14, 16 are engaged with each other, the width $W_1$ of the first portion 36 of each tooth 18 may be less than both the minimum width $W_{min}$ and the maximum width $W_{max}$ of the notch 26. The width $W_2$ of the second portion 38 of each tooth 18 may be greater than the minimum width $W_{min}$ of the notch 26, but less than the maximum width $W_{max}$ of the notch 26. This relationship between the widths of the teeth 18 and notches 26 may facilitate the interlocking engagement of the first and second bodies 14, 16.

FIGS. 7-13 show an exemplary sequence of attaching the first and second bodies 14, 16 together. As used herein, the teeth 18 positioned along the first lateral side 20 of the first body 14 may be referred to as the first set of teeth, while the teeth 18 positioned along the second lateral edge 22 of the first body 14 may be referred to as the second set of teeth. Similarly, the notches 26 positioned along the first lateral edge 28 of the second body 16 may be referred to as the first set of notches, while the notches 26 positioned along the second lateral edge 30 may be referred to as the second set of notches.

The second body 16 may be positioned relative to the first body 14 to define a desired strap length L. Shorter strap lengths L may be associated with greater overlap between the first and second bodies 14, 16, as well as more teeth 18 being received in corresponding notches 26. Longer strap lengths L may be associated with less overlap between the first and second bodies 14, 16, as well as fewer teeth 18 being received in the notches 26. With the second body 16 being generally positioned relative to the first body 14 in accordance with the desired strap length L, and referring now specifically to FIG. 7, the first lateral edge 28 of the second body 16 may be placed on the surface 35 of the base 36 of the first body 14. The first lateral edge 28 may then move toward the first set of teeth 18, as shown in FIG. 8. If the tip 37 of the teeth 18 are aligned with any portion of the V-surface 39 of the corresponding notch 26, the teeth 18 may be received within the notch 26. The second body 16 is moved until the teeth and notches are in perfect alignment. However, if the teeth 18 are aligned with portions of the first lateral edge 28 extending between adjacent notches 26, the user may need to slightly move the second lateral body 16 relative to the first lateral body 14 until such alignment is achieved. If the user urges the notches 26 toward the teeth 18 while making such slight movement, the teeth 18 may be urged into the notches 26 at which point perfect alignment will be achieved. The configuration of the teeth 18 and the corresponding notches 26 may facilitate the above-described alignment therebetween, and may enable one-handed alignment because the user does not need to precisely align the teeth 18 with the notches 26. Rather, the user may simply slide the second body 16 relative to the first body 14 to effectuate the self-alignment.

When the user urges the first set of notches 26 toward the first set of teeth 18, the teeth 18 aligned with corresponding notches 26 may be received within the notches 26. As the teeth 18 are received in the notches 26, some of the projection 56 on the notches 26 may extend below the peripheral surface 46 of the teeth 18 (see FIGS. 6, 6A, and 6B). However, not all of the projections 56 on the notches 26 having teeth 18 received therein may extend under the peripheral surface 46 of the corresponding tooth 18 as the notches 26 are urged toward the teeth 18. In particular, the teeth on edge 22 are not received in the notches on edge 30. Rather, some of the projections 56 may reside above the peripheral surface 46, and on the chamfered surface 44 as shown in FIG. 10. In such instances, the user may apply pressure laterally on the second body 16 to cause the projection 56 to pass over the chamfered surface 44, and over the peripheral surface 56 to reside under the peripheral surface 56 as shown in the progression in FIGS. 11-13. The second body 16 may be flexible and resilient to accommodate such transition of the peripheral surface 56 over the tooth 18.

Although the word "teeth" (plural) is used in the foregoing description, it is understood that for maximum and/or minimum strap lengths L, only one tooth 18 along the first lateral edge 20 of the first body 14 may be received in a corresponding single notch 26 on the first lateral edge 28 of the second body 16.

When the first set of notches 26 have received the first set of teeth 18, the first and second bodies 14, 16 may be in the configuration shown in FIGS. 9-11. As shown in FIG. 9, the projections 56 on the first set of notches 26 are positioned below the peripheral surfaces 46 on the first set of teeth 18, while the projections 56 on the second set of notches 26 are positioned above the peripheral surfaces 46 on the second set of teeth 18. To facilitate engagement between the second set of teeth 18 and the second set of notches 26, the user may apply pressure to the second body 16 to cause the projections 56 on the second set of notches 26 to move along the chamfered surfaces 44 of the second set of teeth 18, and over the peripheral surfaces 46 on the second set of teeth 18. The rounded, arcuate configuration of the projections 56 may ease the passage of the projections 56 over the chamfered surfaces 44 and peripheral surfaces 46. FIGS. 12 and 13 are sequential views of engagement between the first and second bodies 14, 16, as the second sets of teeth 18 and notches 26 become engaged with each other. FIGS. 12 and 13 additionally illustrate flexibility of the second body 16 during the engagement process, as both ends of the second body 16 are flexed upwardly from the middle portion of the second body 16.

When both the first and second sets of notches 26 are engaged with the first and second sets of teeth 18, the projections 56 on the first and second sets of notches 26 are captured between the base 34 and the peripheral surface 46 of the teeth 18. The minimum width $W_{min}$ of the projections 56 being larger than the maximum width $W_1$ of the first portion 36 of the teeth 18, but smaller than the maximum width $W_2$ of the second portion 38 of the teeth 18, within a given cross sectional plane, may allow the projections 56 to be captured between the base 34 and the peripheral surface 46 of the teeth 18.

To remove the second body 16 from the first body 14, the user may grab a free end of the second body 16 and urge the second body 16 to peel the second body 16 away from the first body 14. As the second body 16 is peeled away from the first body 14, the second body 16 and or the first body 14 may be flexed to allow the projections 56 on the notches 26 to pass along the undercut surface 48 and over the peripheral surface 46 until the teeth 18 are removed from the notches 26.

The adjustable connector strap 12 may provide laterally-positioned interlocking between the first and second bodies 14, 16. Such lateral interlocking, with the teeth 18 extending into the second body 16 from a respective lateral edge thereof may provide a strong balance interconnection, particularly when a tension load is applied to the strap 12. Furthermore, the lateral interlocking, and the configuration of the teeth 18 and notches 26 may create a unique and distinctive look that appeals to consumers.

It is understood that the scope of the present disclosure is not limited to the adjustable connector strap 12 described above and shown in FIGS. 1-13. Along these lines, various features of the strap may be varied without departing from the spirit and scope of the present disclosure. FIGS. 14-19 are exemplary of some of the features that may be varied.

Figure 14:
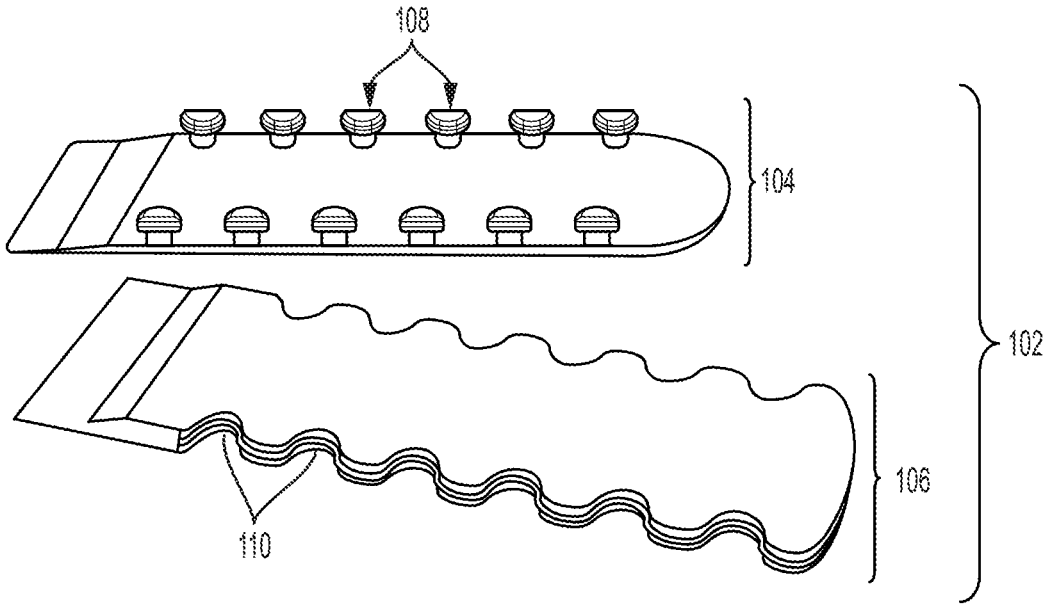
FIG. 14 is an upper perspective view of another implementation of the adjustable connector strap having arcuate teeth and corresponding arcuate notches.

More specifically, FIG. 14 is an upper perspective view of an adjustable connector strap 102 including first and second bodies 104, 106 having arcuate teeth 108 and arcuate notches 110. Each tooth 108 includes an arcuate surface extending inwardly from the corresponding first or second lateral edge. Likewise, each notch 110 includes an arcuate surface extending inwardly from the corresponding first or second lateral edge. The rounded or arcuate configuration of the teeth 108 and notches 110 may create an impression of waves, which consumers may find desirable. The method of attachment and structure may be the same as the embodiment shown in FIGS. 1-13.

Figure 15:
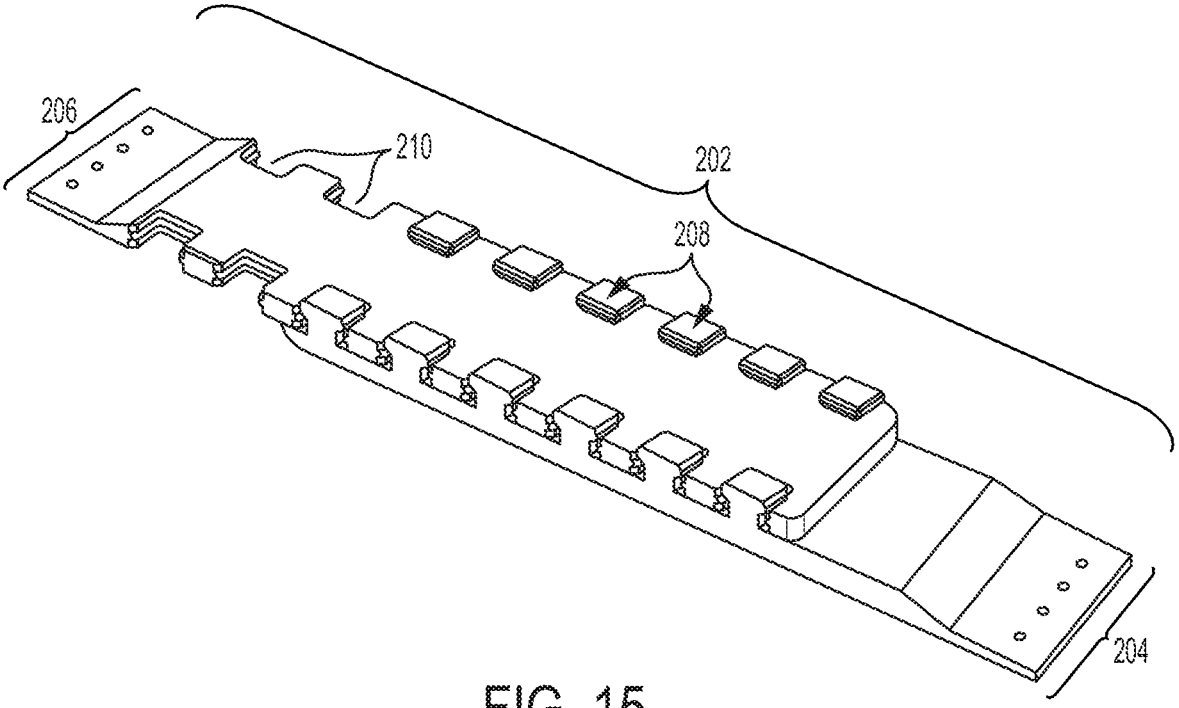
FIG. 15 is an upper perspective view of an embodiment of the adjustable connector strap having quadrangular teeth and notches.
Figure 16:
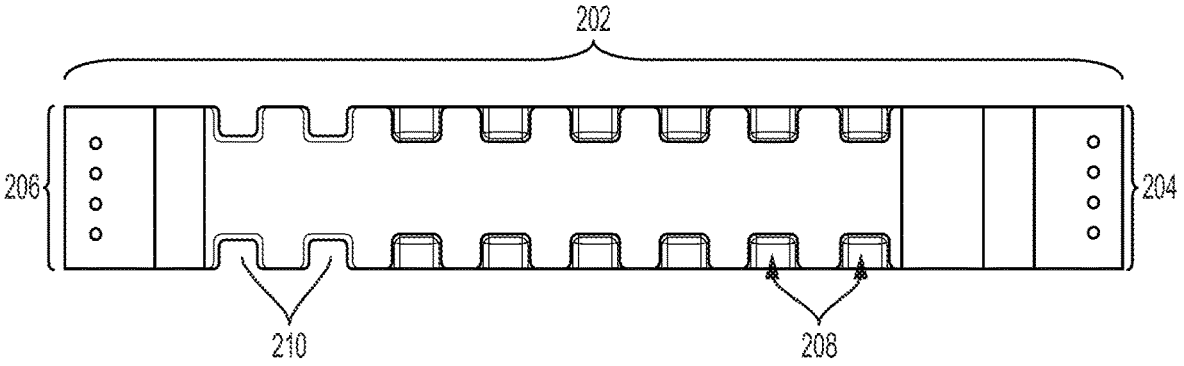
FIG. 16 is a top view of the adjustable connector strap depicted in FIG. 16.

FIGS. 15 and 16 show an adjustable connector strap 202 including first and second bodies 204, 206 having quadrangular teeth 208 and quadrangular notches 210. Each tooth 208 is four sided, with each side of the tooth 208 being generally perpendicular to the adjacent sides of the tooth 208. Similarly, each notch 210 is four sided with each side of the notch 210 being generally perpendicular to the adjacent sides of the notch 210.

The teeth 108, 208 and notches 110, 210 shown in FIGS. 14-16 may be similar to the teeth 18 and notches 26 discussed above, except for their peripheral shape. In this respect, whereas the teeth 18 and notches 26 in FIGS. 1-13 have a triangular periphery, the teeth 108, 208 and notches 110, 210 have an arcuate/semicircular and quadrangular peripheries, respectively. The adjustable strap connectors 102, 202 may function similar to the adjustable strap connector 12 described above, and thus, the reader is directed to the above-description regarding connection and disconnection of the adjustable strap connector 12.

Figure 17:
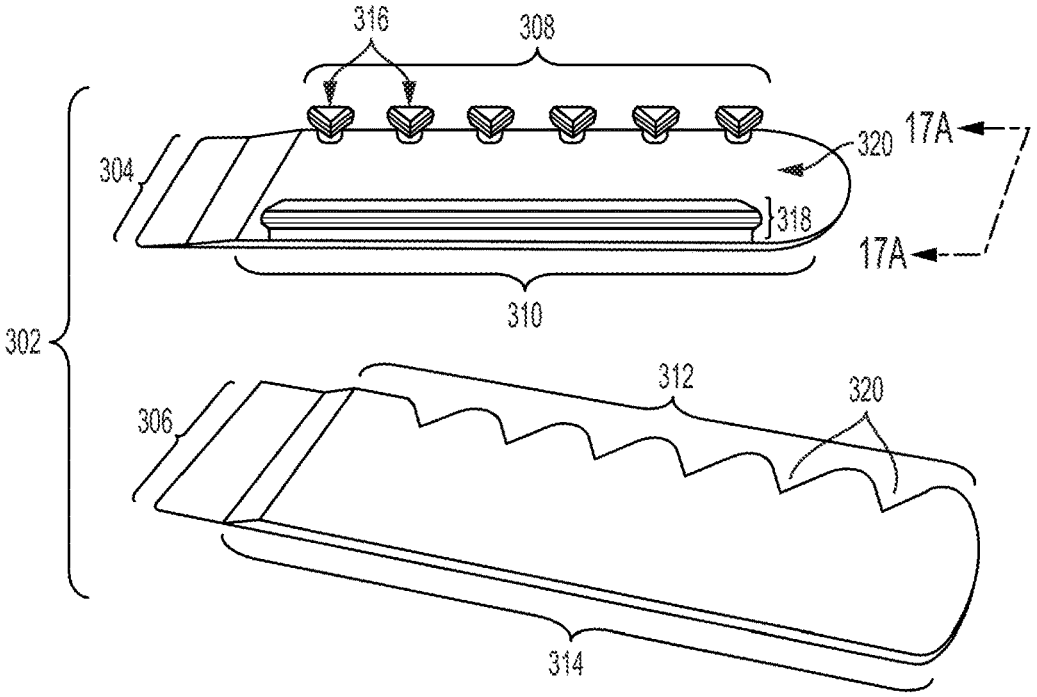
FIG. 17 is an upper perspective view of yet another implantation of the adjustable connector strap having teeth and notches on one side, and an abutment wall on an opposing side of the adjustable connector strap.
Figure 17A:
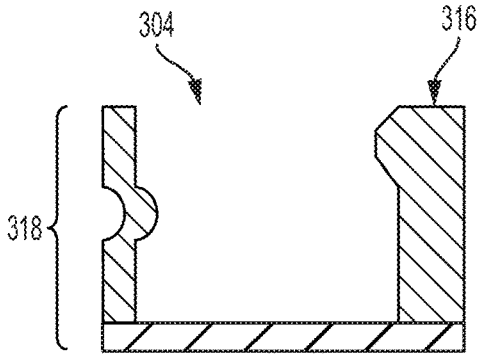
FIG. 17A is an end view of a first body of the adjustable connector strap depicted in FIG. 17.

Referring now to FIG. 17, an adjustable strap connector 302 is shown having teeth and notches formed along only one lateral side thereof. More specifically, the adjustable strap connector 302 may include a first body 304 and a second body 306, with each of the first and second bodies 304, 306 having respective first lateral sides 308, 312, and second lateral sides 310, 314. The first body 304 includes a plurality of teeth 316 positioned adjacent the first lateral side 308 and an elongate abutment wall 318 positioned adjacent the second lateral side 310. The second body 306 includes a plurality of notches 320 formed adjacent the first lateral side 312. The second lateral side 314 defines an elongate, generally linear edge or surface, which may interface with the elongate abutment wall 318 of the first body 304.

The second body 306 may be connected to the first body 304 by positioning the second body 306 relative to the first body 304 in a position generally associated with a desired strap length L. The second lateral edge 314 of the second body 306 may then be placed on the first body 304, and then moved toward the abutment wall 318. The abutment wall 318 may be structured to at least partially capture the second lateral edge 314 of the second body when inserted therein. The abutment wall 318 may include a proximal portion extending away from a base 320 of the first body 304, and a distal portion extending from the proximal portion. The distal portion may extend toward the first lateral edge 308 to define a channel or void between the distal portion and the base 320 to receive and capture the second lateral edge 314 of the second body 306. When the second lateral edge 318 is placed against the abutment wall 318, the notches 320 may be pressed against the teeth 316 to complete engagement between the first and second bodies 304, 306.

Figure 18:
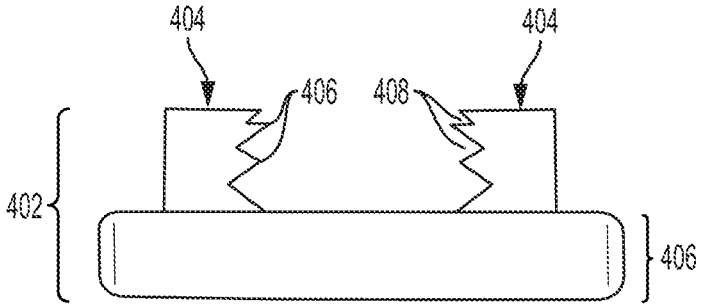
FIG. 18 is an end view of a connector body forming part of another implementation of an adjustable connector strap.

Referring now to FIG. 18, an end view of a first body 402 of an adjustable connector strap is shown. The first body 402 includes multiple teeth 404 extending from a base 406, wherein each tooth 404 has a jagged profile comprising multiple tips 406 and recesses 408. The jagged profile may allow for a more secure engagement with the corresponding second body (not shown). When the second body is pressed into engagement with the first body 402, the passage of the projections on the second body over the tips 406 on the first body 402 may produce a clicking sound. Thus, when the second body is completely engaged with the first body, each projection wall may produce multiple clicking sounds. It is contemplated that the second body may be single-layered, similar to the second bodies described above, wherein a single layer of projections may pass through each layer of tips 406. Alternatively, the second body may be multi-layered, wherein each layer resides under a corresponding tip on the first body 402.

Figure 19:
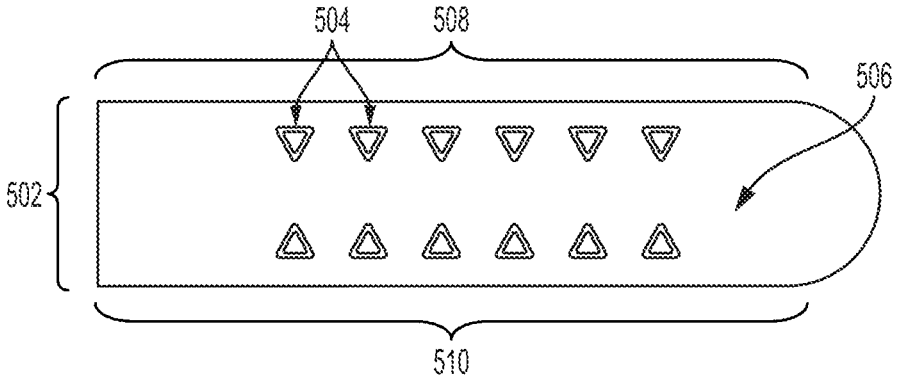
FIG. 19 is a top view of a connector body forming part of yet another implementation of an adjustable connector strap.

Referring now to FIG. 19, a first body 502 of an adjustable connector strap is shown wherein the first body 502 includes a plurality of teeth 504 extending from a base 506. The teeth 504 may be spaced from first and second lateral edges 508, 510 of the first body 502. The first body 502 may function similar to the first bodies described above, with the primary distinction being the inward placement of the teeth 504.

Figure 20:
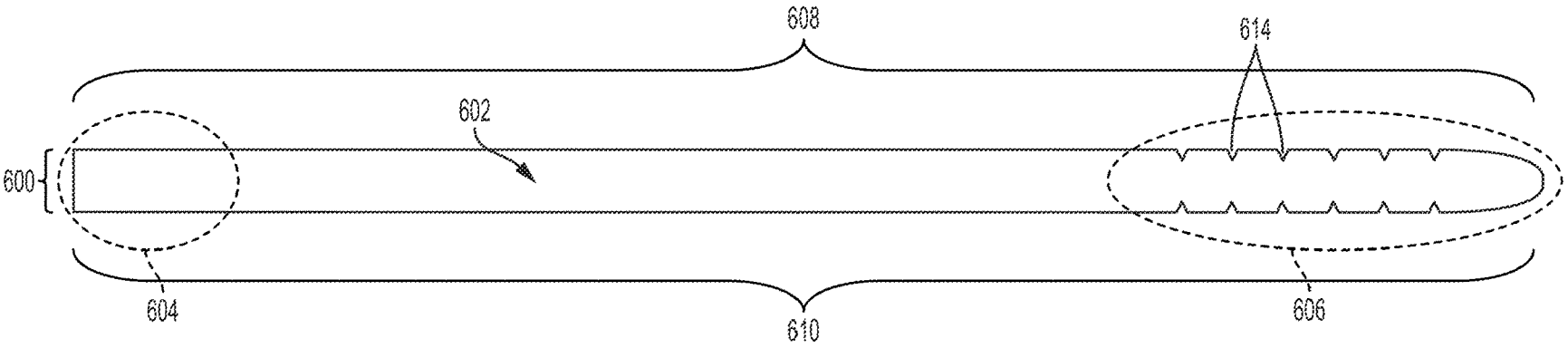
FIG. 20 is a bottom view of a belt having a connector according to an aspect of the present disclosure.
Figure 21:
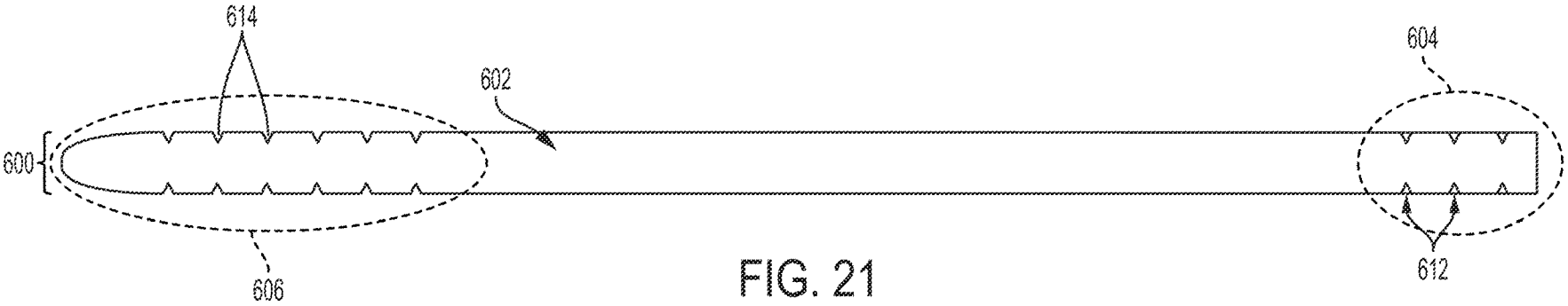
FIG. 21 is a top view of the belt depicted in FIG. 20.

Referring now to FIGS. 20 and 21, there is shown a belt 600 having a connector constructed in accordance with one aspect of the present disclosure. FIG. 20 is a top view of the belt 600 and FIG. 21 is a bottom view of the belt 600. The belt 600 may include a main body 602 having a first end portion 604, a second end portion 606, and a pair of opposed lateral sides 608, 610. The first end portion 604 may include a plurality of teeth 612 extending from the main body 602, with each tooth 612 being positioned adjacent one of the lateral sides 608, 610. The second end portion 606 may includes a plurality of notches 614 extending into the main body 602, wherein each tooth 612 being positioned adjacent one of the lateral sides 608, 610.

The belt 600 may be fastened around a wearer by encircling the belt 600 around a user, and overlapping at least a part of the first and second end portions 604, 606. The teeth 612 may be aligned with the notches 614 and engaged with each other, as explained in more detail above. The size of the circumference defined by the belt 600 when the teeth 612 are engaged with the notches 614 may be adjusted by modifying the degree of overlap of the first and second portions 604, 606, as well as changing the number of teeth 612 received in corresponding notches 614.

Although the foregoing describes various embodiments of adjustable connector straps in connection with hats and belts, it is understood that the adjustable connector strap may be incorporated into other items needing size adjustment. For instance, the adjustable connector strap may be used as a substitute for hooks and loops fasteners, as the adjustable connector strap may be capable of withstanding higher tensile loads, since the interlocking teeth and notches may be positioned perpendicularly to the tensile loads.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. An adjustable connector strap for an article of clothing, the adjustable connector strap comprising:

a first body portion extending along a first longitudinal axis, the first body portion having:

a base having a pair of opposed lateral edges; and a plurality of teeth extending from the base, the plurality of teeth comprising a first set of teeth and a second set of teeth positioned adjacent respective ones of the pair of opposed lateral edges;

each tooth having a first tooth portion and a second tooth portion, the first tooth portion being positioned between the second tooth portion and the base;

each tooth defining a width in a direction parallel to the first longitudinal axis, the maximum width of the second tooth portion being greater than the maximum width of the first tooth portion;

a second body portion extending along a second longitudinal axis, the second body portion having:

a pair of opposed lateral edges; and a plurality of notches comprising a first set of notches and a second set of notches, the plurality of notches being complimentary in shape to the plurality of teeth;

the second body portion being selectively engagable with the first body portion in a first engaged configuration and a second engaged configuration, the number of teeth being received in corresponding ones of the plurality of notches increasing as the second body portion transitions from the first engagement configuration to the second engagement configuration;

wherein the second body portion includes a first surface, an opposing second surface, a plurality of sidewalls extending between first and second surfaces, and a plurality of projections extending from respective ones of the plurality of sidewalls; and wherein in a cross sectional plane passing through both the first and second body portions when the second body portion is in the first engaged configuration, the cross sectional plane being parallel to the first and second longitudinal axes and passing through at least one tooth and at least one notch, the at least one tooth having a first tooth portion width defined by the first tooth portion and a second tooth portion width defined by the second tooth portion, the at least one notch having a maximum width and a minimum width, the minimum width being defined by the projection, the minimum width being greater than the first tooth portion width and less than the second tooth portion width.

2. The adjustable connector strap recited in claim 1, wherein the each of the first set of teeth is aligned with a corresponding one of the second set of teeth along a respective axis perpendicular to the first longitudinal axis.

3. The adjustable connector strap recited in claim 1, wherein each of the first set of notches is aligned with a corresponding one of the second set of notches along a respective axis perpendicular to the second longitudinal axis.

4. The adjustable connector strap recited in claim 1, wherein each tooth includes a triangular periphery.

5. The adjustment strap of claim 1 wherein each of the plurality of teeth has a ridge line and each of the plurality of notches have a lip to enhance the ability of the adjustment strap to maintain its interlocking strength during tension loads.

6. The adjustment strap of claim 1 wherein the plurality of triangular notches and the plurality of triangular teeth are inwardly directed to enhance the speed of installation, adjustment and disengagement of the first and second portions.

7. The adjustment strap of claim 1 wherein the first and second portions are fabricated from at least one of plastic, rubber and silicone.

8. The adjustment strap of claim 1 wherein the ridge line of the plurality of teeth is disposed above the lip of the plurality of notches when the first and second portions are interlocked.

* * * * *